US005791712A

United States Patent [19]

Hawn

[11] Patent Number: 5,791,712

[45] Date of Patent: Aug. 11, 1998

[54] SPEAR FISHING TOOL

[75] Inventor: Clifford W. Hawn, Benton, La.

[73] Assignee: Weatherford/Lamb, Inc., Houston, Tex.

[21] Appl. No.: 675,087

[22] Filed: Jul. 3, 1996

[51] Int. Cl.[6] ..... E21B 31/20

[52] U.S. Cl. ..... 294/86.15; 294/86.17; 294/86.25

[58] Field of Search ..... 294/86.14, 86.15, 294/86.17, 86.19, 86.24, 86.25, 86.34, 95

[56] References Cited

U.S. PATENT DOCUMENTS

| | | | |
|---|---|---|---|
| 803,450 | 10/1905 | Stegner . | |
| 808,378 | 12/1905 | Johnston . | |
| 1,457,139 | 5/1923 | Bell et al. . | |
| 1,580,352 | 4/1926 | Ventresca . | |
| 1,619,254 | 3/1927 | Hart . | |
| 1,621,947 | 3/1927 | Moore . | |
| 1,638,494 | 8/1927 | Lewis . | |
| 1,712,898 | 5/1929 | Newkirk . | |
| 1,728,136 | 9/1929 | Power . | |
| 1,779,123 | 10/1930 | Gates . | |
| 1,794,652 | 3/1931 | Stone . | |
| 1,815,462 | 7/1931 | Denney . | |
| 1,823,340 | 9/1931 | Vance . | |
| 1,917,135 | 7/1933 | Littell . | |
| 2,141,987 | 12/1938 | Jones | 294/96 |
| 2,245,571 | 6/1941 | Chappell | 294/86.24 |
| 2,290,409 | 7/1942 | Cuthill | 294/93 |
| 2,732,901 | 1/1956 | Davis | 166/98 |
| 2,806,534 | 9/1957 | Potts | 166/98 |
| 3,199,906 | 8/1965 | Chenoweth | 294/86.15 |
| 3,262,501 | 7/1966 | Winger | 166/31 |
| 3,265,431 | 8/1966 | Burner | 294/86.25 |
| 3,638,989 | 2/1972 | Sanquist | 294/86.24 |
| 4,244,616 | 1/1981 | Buchalet | 294/86.15 |
| 4,443,130 | 4/1984 | Hall | 405/190 |
| 4,616,721 | 10/1986 | Furse | 175/320 |
| 4,723,372 | 2/1988 | Sheshtawy | 294/86.15 |
| 4,838,594 | 6/1989 | Bullard | 294/86.25 |
| 5,242,201 | 9/1993 | Beeman | 294/86.17 |
| 5,580,114 | 12/1996 | Palmer | 294/86.15 |

*Primary Examiner*—Dean Kramer
*Attorney, Agent, or Firm*—John M. Harrison

[57] ABSTRACT

A spear fishing tool for engaging an object to be removed from a well bore, commonly called a "fish". The spear fishing tool is characterized by a cylindrical housing, typically attached to a length of coiled tubing by means of a top sub and fitted with a reciprocating, hydraulically-operated plunger seated on an internal spring and having a bevelled end facing the down-hole "fish". Multiple latch fingers lie adjacent to the housing and are movably secured in place between the housing and plunger by means of a slotted finger collar threadably attached to the housing. The piston is further provided with a piston groove or slot that selectively matches corresponding lobes formed in the latch fingers, respectively, to facilitate the following: engagement of the tool housing with the fish; hydraulic extension of the piston downwardly with respect to the housing to effect retraction of the latch finger lobes into the piston groove or slot; extension of the tool housing through the fish neck opening; and spring-biased retraction of the piston upwardly to mismatch the finger lobes and the piston groove or slot and extend the latch finger lobes from the piston groove or slot into engagement with the internal groove of the fish.

5 Claims, 3 Drawing Sheets

FIG. 1
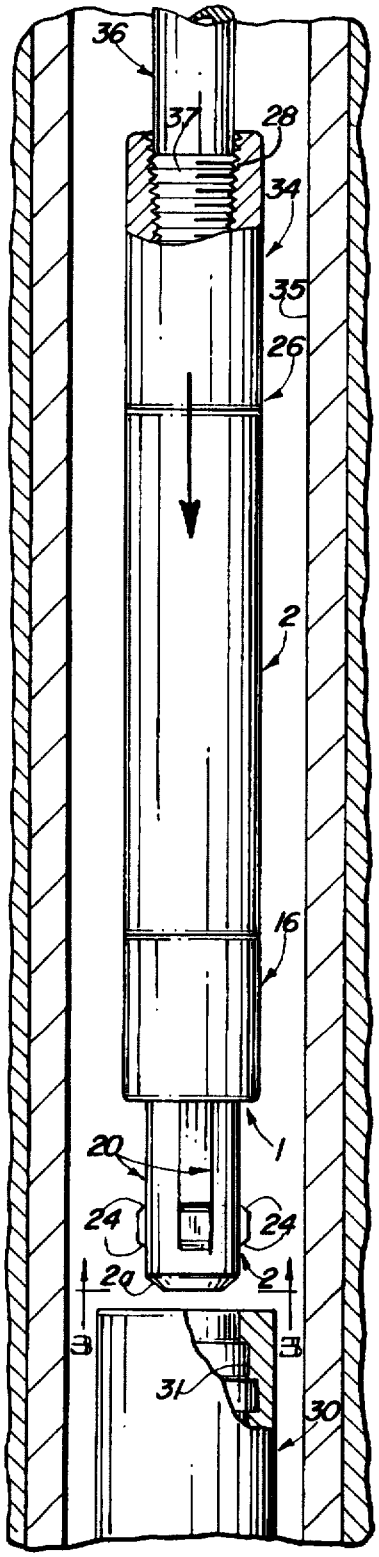
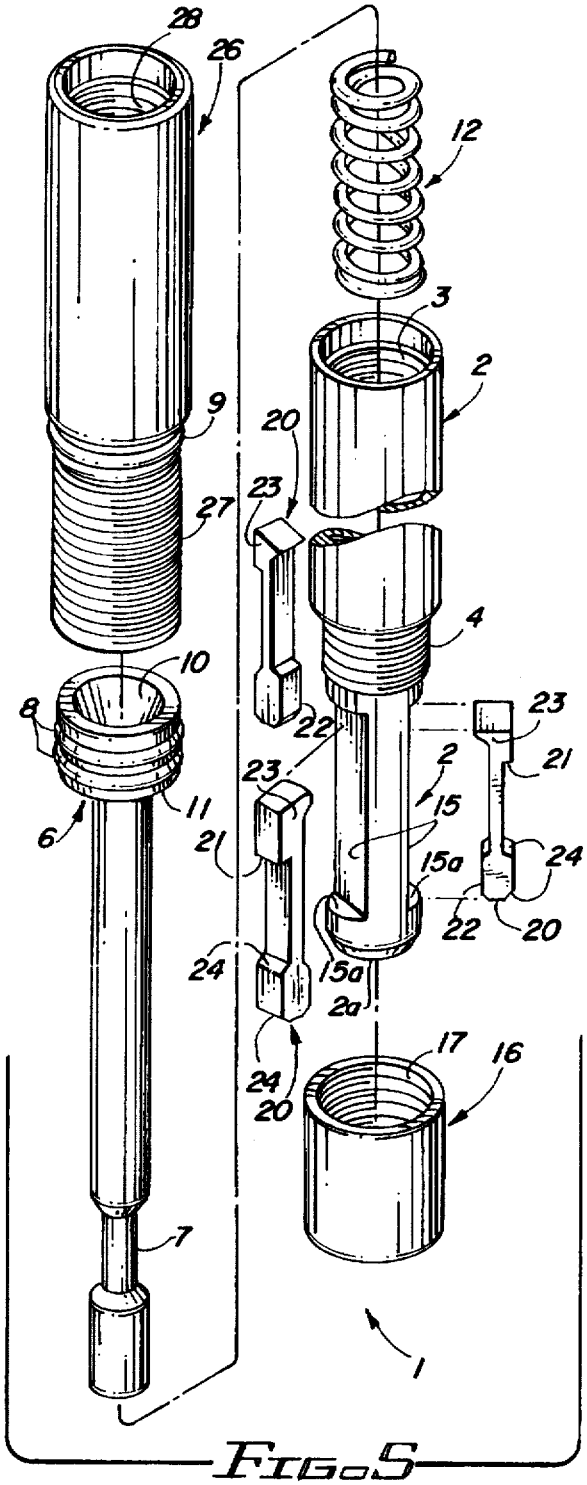
FIG. 5

SPEAR FISHING TOOL

BACKGROUND OF THE INVENTION

1. Field of the Invention

This invention relates to fishing tools and more particularly, to a spear fishing tool designed to automatically engage the receiving element or neck of a "fish" located in an oil or gas well in order to retrieve a drill string, tools or other objects from the well bore. The need to retrieve such objects is frequently realized in the drilling of oil and gas wells due to operating and mechanical failure and the need for a reliable, fluid-activated connecting and disengaging fishing tool for achieving this purpose, is well recognized.

2. Description of the Prior Art

Various tools and devices have been developed over the years for retrieving drill string as well as casing or tubing string, tools and other objects from the bottom of a well bore. Specifically, various tools, including casing spears of various design, most of which spears utilize a bevelled expansion surface and various types of engaging apparatus in conjunction with the bevelled surface, are well known. Typical of these devices is the "Casing Spear" detailed in U.S. Pat. No. 803,450, dated Oct. 31, 1905 to J. Stegner; U.S. Pat. No. 808,378, dated Dec. 26, 1905 to H. G. Johnston entitled "Automatic Rotary Hydraulic Casing Spear"; U.S. Pat. No. 1,457,139, dated May 29, 1923, to A. L. Bell, et al, detailing a "Fishing Tool"; U.S. Pat. No. 1,580,352, dated Apr. 13, 1926, to E. Ventresca, entitled "Well Fishing Tool"; U.S. Pat. No. 1,619,254, dated Mar. 1, 1927, to C. Hart, entitled "Spear"; U.S. Pat. No. 1,621,947, dated Mar. 22, 1927, to W. N. Moore, entitled "Casing Puller"; U.S. Pat. No. 1,638,494, dated Aug. 9, 1927, to R. C. Lewis, et al, entitled "Casing Puller and Cutter"; U.S. Pat. No. 1,712,398, dated May 14, 1929, to E. H. Newkirk, entitled "Inside Fishing Tool".

Other designs include multiple gripping elements that are designed to retract upon insertion into a "fish" or similar tool or mechanical device and expand after the insertion. Typical of these tools is the "Casing Spear" detailed in U.S. Pat. No. 1,728,136, dated Sep. 10, 1929, to E. D. Power. The tool includes movable gripping elements and a mechanism for normally urging the gripping elements to a collapsed position for insertion into a well casing and upon the pumping of mud fluid into the pipe, allowing the gripping elements to expand for engagement with the casing and facilitate removal of the casing from the well. U.S. Pat. No. 1,779,123, dated Oct. 21, 1930, to P. G. Gates, details a "Hydraulic Casing Spear" having inclined guides and slips which are movable upon the guides to assume a contracted or expanded position to first enter a "fish", casing, tubing or other object in the well and then affect an expansion of the slips to remove the object from the well. U.S. Pat. No. 1,794,652, dated Mar. 3, 1931, to F. Stone, details a "Hydraulic Trip Spear" which includes multiple jaws or gripping members maintained in a radially-retracted position as the tool is lowered into a working position and then expanded into a radially-extended gripping engagement with the bore defining wall of the work to be removed from the well. U.S. Pat. No. 1,815,462, dated Jul. 21, 1931, to H. J. Denney, details a "Pipe Puller", having pipe-engaging jaws which are activated by fluid pressure to secure the jaws inside a length of tubing or casing to be removed from a well. U.S. Pat. No. 1,823,340, dated Sep. 15, 1931, to V. O. Vance, details a "Fishing Tool" having a slip assembly which vertically reciprocates in the barrel of the tool in connection with a shoe, such that upon reciprocation it may be retracted into engagement with a fish in a well and expanded to remove the fish from the well. U.S. Pat. No. 1,917,135, dated Jul. 4, 1933, to J. Littell, details a "Well Apparatus", having multiple slips movable by gravity from a normally retracted position into coupling engagement with a well casing or other fish to remove the fish from a well bore. U.S. Pat. No. 2,141,987, dated Dec. 27, 1938, to F. P. Jones, details a "Casing Spear", which spear includes multiple ribs and a pressure chamber with packing provided on the device above the ribs for expansion radially outwardly by hydraulic pressure-engaged slips provided on the ribs into an expanded position with the fish to be removed from a well bore. U.S. Pat. No. 2,290,409, dated Jul. 21, 1942, to J. Cuthill, details a tool which uses a sleeve of elastic material positioned within jaws designed to grip the fish, such that fluid pressure directed to the interior of the sleeve forces the jaws outwardly into engagement with the fish for removing the fish from the well bore. U.S. Pat. No. 2,732,901, dated Jan. 31, 1956, to L. Davis, details a "Hydraulically Operated Pulling Tool". The device includes slips mounted in a housing and a continuous flow passage for well bore fluid, which passage can be selectively closed to force the slips against casing, tubing or other fish downhole to remove the fish from the well bore. U.S. Pat. No. 2,806,534, dated Sep. 17, 1957, to E. L. Potts, details a "Hydraulic Pulling Tool For Use in Wells", which tool includes a tubular stem telescopically enclosed within a tubular sleeve that defines one or more hydraulic cylinders about the stem. Anchoring members are provided on the stem and a grapple is located on the lower end of the device and adapted to grasp the "fish" to be pulled from the well. U.S. Pat. No. 3,199,906, dated Aug. 10, 1965, to D. V. Chenoweth, details a "Releasable Fluid Control Apparatus For Retrieving Sub-Surface Well Devices". The device includes a check valve to facilitate retention of hydraulic fluid inside the device and release of hydraulic fluid pressure from the device to effect selected engagement of the device with a fish for removal of the fish from the well bore. U.S. Pat. No. 3,262,501, dated Jul. 26, 1966, to S. L. Winger, details "Apparatus For Pulling A Well Liner". The device includes a rotary valve located on the lower end of a drill string in conjunction with an annular rubber packer fitted inside the well casing and a spear assembled on the lower end of the packer, such that the spear is operable to selectively engage the liner. U.S. Pat. No. 3,638,989, dated Feb. 1, 1972, to Sandquist, details an "Apparatus For Recovering A Drill Stem". The device utilizes a fluid chamber inside a housing or body with multiple, angularly-disposed cavities fitted with engaging slips for engaging a "fish" located in a well. U.S. Pat. No. 4,273,372, dated Jun. 16, 1981, to Sheshtawy, details an "Apparatus For Use In Lowering Casing Strings". The device includes a running tool having extendible latches with left-handed threads for engagement with similar threads on the inside of casing to be lowered in a well. Tapered blocks are spring-loaded for expanding dogs into position and disengage the running tool from the equipment lowered into the well. U.S. Pat. No. 4,443,130, dated Apr. 17, 1984, to Douglas D. Hall, details a "Remotely Operated Tool for Performing Functions Under Water". The tool includes a tool body attached to a handling string with multiple jaw members carried by the body for movement between an inactive position and an active position engaging an object to be removed. U.S. Pat. No. 4,616,721, dated Oct. 14, 1986, to John H. Furse, details a "Packer Mill" for removing a packer from a well. The device includes a releasable catcher having a sleeve with deflectable fingers, wherein the fingers press on a release ring if the packer should become stuck. The release ring has a ramp that engages a complimentary ramp on the mandril of the mill. The ramps cam the ring outwardly thus permitting the fingers to deflect inwardly into a recess and clear the bore of the stuck packer. U.S. Pat. No. 5,242,201, dated Sep. 7, 1993, to Robert S. Beeman, details a "Fishing Tool" having multiple collets that are initially displaced against spring tension by the fish until the collets enter the fish, where they are then displaced outwardly to engage the fish and remove the fish from the well bore.

It is an object of this invention to provide new and improved, simplified spear fishing tool for removing "fish" of various character from a well bore, which tool includes a housing equipped at one end for receiving multiple, radially spaced-apart latch fingers and a fluid-actuated piston slidably extending through the housing and fitted with a piston groove, slot or slots for selectively receiving the engaging ends of the latch fingers and allowing the housing to extend into the fish, wherein the latch fingers then engage the fish responsive to reciprocation of the piston to mismatch the piston groove and the engaging ends of the latch fingers and remove the fish from the well.

Another object of this invention is to provide a new and improved spear fishing tool which may be typically suspended from the end of a length of tubing and includes a housing fitted with a fluid-operated piston and multiple latch fingers laterally or radially movably mounted in the housing and a slot or groove provided in the piston, such that the piston may be reciprocated within the housing to initially facilitate alignment and recessing of the engaging ends or lobes of the latch fingers with the slot or groove, insertion of the working end of the tool into the "fish" and the piston subsequently again reciprocated inside the tool housing in the opposite direction to disengage the latch finger lobes from the slot or groove in the piston and cause the lobes to engage the fish.

A still further object of this invention is to provide a new and improved spear fishing tool for removing various objects, or "fish" from a well bore, which tool includes a cylindrical housing of sufficient size to fit in the well bore and fitted with a reciprocating piston having one or more slots or a groove at the working end and a return spring provided in the housing and operable to normally bias the piston in an upward position in the housing. Multiple latch fingers are also movably radially positioned on the housing by means of a slotted collar threaded on the housing for selective pivotal engagement with the slot(s) or groove of the piston. The tool may be lowered into the well bore and the working end of the tool inserted in the opening or neck of a "fish" responsive to extension of the piston with respect to the housing against the bias of the return spring by application of fluid pressure. This action causes the piston slot(s) or groove to align with the operating ends or lobes of the latch fingers and the lobes to move or pivot inwardly and engage the groove or slot(s) in the piston. Release of fluid pressure from the piston when the working end of the tool is fully inserted in the fish causes the piston to move upwardly, mismatching the piston groove or slots, and the finger lobes and thus disengaging the latch finger lobes from the groove or slot(s) in the piston and engaging the lobes with the slot or groove provided in the "fish".

SUMMARY OF THE INVENTION

These and other objects of the invention are provided in a spear fishing tool which is capable of being lowered into a well bore and securely engaging a "fish" of various description in the well bore, which tool includes a cylindrical housing fitted with a normally upwardly-biased, spring-loaded piston and multiple latch fingers having an operating end or lobe selectively radially movable into and from a groove provided in the working end of the piston. Engagement of the working end of the spear fishing tool with the down-hole "fish" is effected by initial application of hydraulic working fluid pressure on the piston to displace the piston downwardly against the bias of the spring and facilitate radial recession of the latch finger lobes into the groove in the piston. This action allows the working end of the tool to be fully inserted into the fish. Securing of the tool to the fish is then effected by release of hydraulic working fluid pressure from the piston, which allows the spring tension to return the piston to its original position, wherein the piston groove and the latch finger lobes are mismatched, which action forces the latch finger lobes radially outwardly into engagement with the slot provided in the fish. Disengagement of the spear fishing tool from the fish is accomplished by reversing these steps.

BRIEF DESCRIPTION OF THE DRAWINGS

The invention will be better understood by reference to the accompanying drawings, wherein:

FIG. 1 is a perspective view, partially in section, of a preferred embodiment of the spear fishing tool of this invention suspended in a well bore having a casing;

FIG. 5 is an exploded view of the spear fishing tool;

DESCRIPTION OF THE PREFERRED EMBODIMENTS

Figure 2:
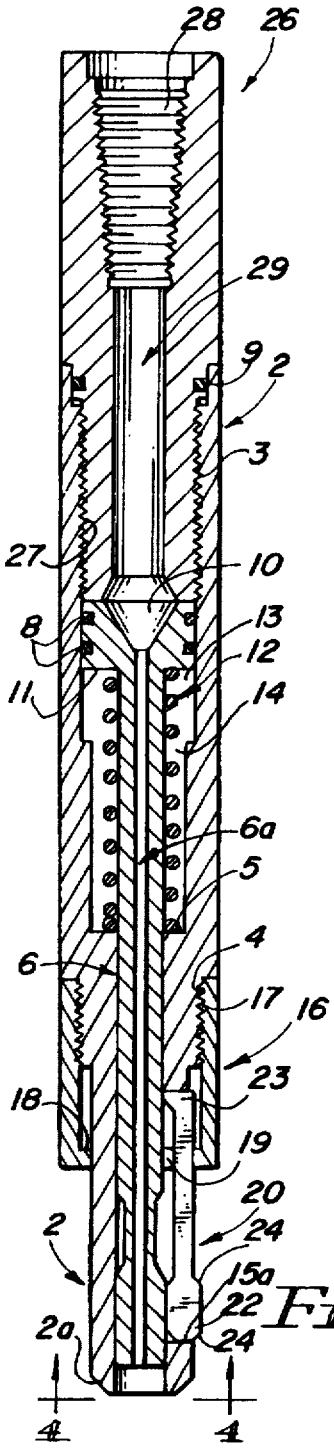
FIG. 2 is a longitudinal sectional view of the spear fishing tool illustrated in FIG. 1.

Referring initially to FIGS. 1–5 of the drawings, in a preferred embodiment the spear fishing tool of this invention is generally illustrated by reference numeral 1. The spear fishing tool 1 is characterized by a cylindrical housing 2, provided with a housing bevel **2*a* at the working end thereof and fitted with housing-sub threads 3 at the opposite or mounting end thereof. The housing 2 is attached to a top sub 26 at the mounting end by means of sub-housing threads 27 and the top sub 26 is fitted with a sub bore 29 and conventional internal sub threads 28 for threadable attachment to a length of tubing 36, having cooperating tubing threads 37, for suspending the spear fishing tool 1 into a well bore 34, typically fitted with casing 35. The housing 2 is further provided with housing collar threads 4 and an internal housing shoulder 5** for receiving one end of a piston spring 12, the opposite end of which piston spring 12 extends upwardly through a spring chamber 14 into a wider piston travel space 13, as illustrated in FIG. 2. A piston 6 is slidably disposed within the housing 2 and is characterized by a longitudinal piston bore 6a, a piston slot or groove 7 provided in the working end of the piston 6 and piston seals 8 provided in the larger upper end of the piston 6, which seal the reciprocating travel of the large end of the piston 6 through the piston travel space 13, against the bias of the piston spring 12 as hereinafter further described. The upper end of the piston spring 12 engages the piston shoulder 11 of the piston 6, as illustrated in FIG. 2. A housing seal 9 is provided between the housing and the top sub 26, as illustrated in FIG. 2. In a preferred embodiment of the invention a piston bevel 10 is provided in the upper end of the piston 6 to accommodate hydraulic fluid 33, illustrated in FIGS. 6B and 6C, which is pumped down the tubing 36 and through the sub bore 29, against the piston bevel 10 of the piston 6, for displacing the piston 6 through the piston travel space 13 against the bias of the piston spring 12. Hydraulic fluid 33 is also allowed to flow through the piston bore 6a, as further hereinafter described during the operational phase of the spear fishing tool 1, for the purpose of clearing the fish groove 31 and fish opening 32 of sand and other foreign material.

Figure 4:
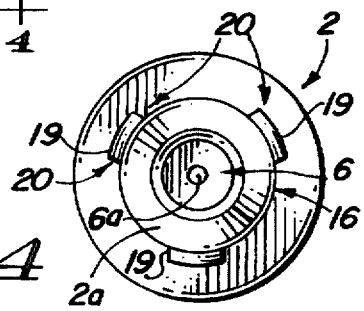
FIG. 4 is an end view of the working or operating end of the fishing tool illustrated in FIG. 1, with three latch fingers mounted in the housing.
Figure 3:
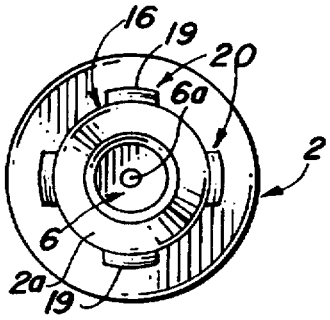
FIG. 3 is an end view taken along line 3—3 of the working or operating end of the spear fishing tool illustrated in FIG. 1, with four latch fingers mounted in the housing.

Referring now to FIGS. 2, 4 and 5 of the drawings, in a most preferred embodiment of the invention the working end of the housing 2 is fitted with a housing bevel 2a and a seat bevel 15a is provided in each of multiple finger seats 15, radially disposed around the periphery of the working end of the housing 2. Furthermore, latch fingers 20 are seated in the respective finger seats 15 spaced in the housing 2 and each of the latch fingers 20 is provided with a finger shoulder 21, which lies adjacent to a corresponding collar shoulder 18 of a finger collar 16, which is threaded on the working end of the housing 2 by means of collar threads 17. The finger base 23 of each of the latch fingers 20 lies adjacent to the upper end of the respective finger seat 15. The finger collar 16 is further provided with collar opening 19 at the bottom thereof, to accommodate the respective latch fingers 20, as illustrated in FIG. 2. Accordingly, when the finger collar 16 is threaded on the collar threads 4 of the housing 2 and the latch fingers 20 are extended through the collar opening 19 and positioned in the corresponding finger seats 15 provided in the housing 2, the latch fingers 20 are prevented from exiting the finger seats 15 but are not tightly secured therein. The latch fingers 20 are each further provided with a finger lobe 22 which extends inwardly of the latch fingers 20 toward the piston 6 and the finger lobes 22 are normally disposed alongside the circumference of the piston 6 below the piston slot or groove 7, as further illustrated in FIG. 2. The bottom ends of the latch fingers 20 are normally seated on the seat bevel 15a of the piston 6 when the piston spring 12 is relaxed and the piston 6 remains in its extreme upward travel position against the base of the top sub 26 and clearing the piston travel space 13, as still further illustrated in FIG. 2. In another preferred embodiment of the invention a finger bevel 24 is provided on the top and bottom ends of each of the latch fingers 20 for engaging a fish 30, located in the well bore 34, for attachment to and removal from the fish 30, as hereinafter further described with respect to FIGS. 6A–6D. As further illustrated in FIGS. 6A–6D, the fish 30 is characterized by a fish opening 32, in the periphery of which is defined the fish groove 31, which is compatible dimensionally with the projecting outer edge of the latch fingers 20.

Figure 6A:
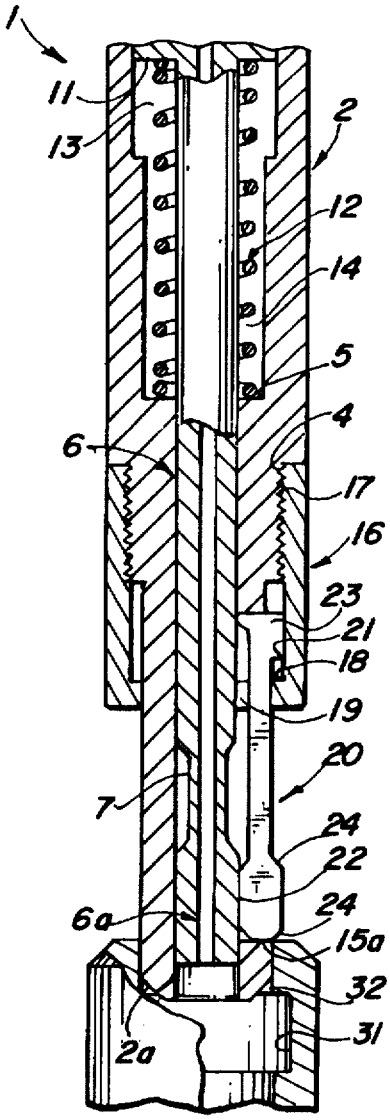
FIG. 6A is a sectional view of the spear fishing tool in operation, with the working end engaging a "fish"
Figure 6D:
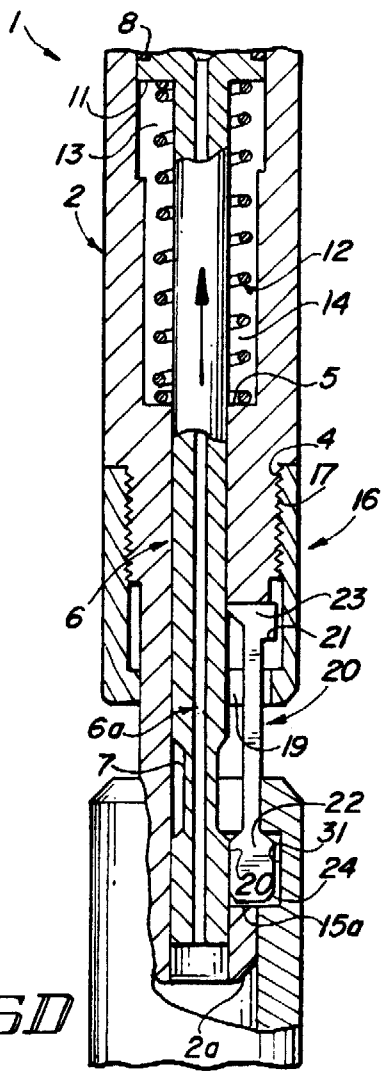
FIG. 6D is a sectional view of the spear fishing tool in operation, with the latch finger lobes radially and pivotally extended into the groove or slot in the "fish".
Figure 6C:
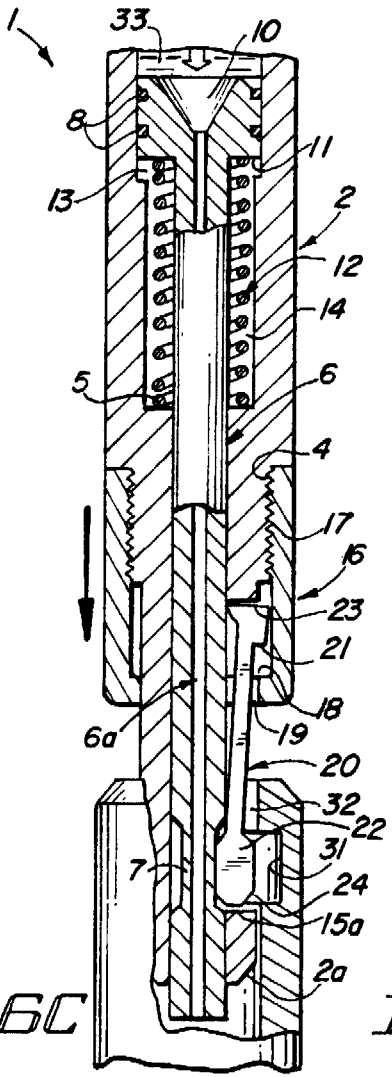
FIG. 6C is a sectional view of the spear fishing tool in operation, with the retracted latch fingers positioned adjacent to a groove or slot in the "fish"

In operation, and referring now to FIGS. 6A–6D, the spear fishing tool 1 is suspended by means of the top sub 26 and the tubing 36 or other suspension apparatus into the well bore 34 until the working end of the spear fishing tool 1 approaches the object to be engaged, such as the fish 30. Referring initially to FIG. 6A, as the working end of the housing 2 enters the fish opening 32 and the bottom finger bevel 24 of each of the respective latch fingers 20 contact the fish 30 at the fish opening 32, hydraulic or working fluid 33 pressure is exerted by means of a suitable pump (not illustrated) through the tubing 36 and the sub bore 29 on the piston bevel 10 of the piston 6, against the bias of the piston spring 12. This action causes the piston 6 to displace downwardly with respect to the housing 3 and close the piston travel space 13 as the piston spring 12 compresses, as illustrated by the piston arrow in FIG. 6B. Working fluid 33 also traverses the piston bore 6a and washes sand and foreign matter from the underlying fish 30. Continued downward movement of the piston 6 responsive to the pressure of the hydraulic fluid 33 in the sub bore 29 causes the piston slot or groove 7 to align with the respective finger lobes 22 of the corresponding latch fingers 20 and the pressure of the fish 30 against the respective bottom finger bevels 24 of the latch fingers 20 pivots the latch fingers 20 at each finger base 23 and forces the finger lobes 22 radially into the piston slot or groove 7, thus facilitating movement of the working end of the spear fishing tool 1 farther into the fish opening 32, as further illustrated in FIG. 6B. Each of the latch fingers 20 remain depressed with the corresponding finger lobes 22 seated in the matching piston slot or groove 7 as the working end of the spear fishing tool 1 moves through the fish opening 32 and the respective latch fingers 20 align with the conventional fish groove 31 provided in the fish 30, as illustrated in FIG. 6C. When alignment of the latch fingers 20 with the fish groove 31 is effected, hydraulic or working fluid 33 pressure is released from the tubing 36 of the sub bore 29 and the piston spring 12 extends, thus facilitating upward movement of the piston 6 with respect to the housing 3 as indicated by the piston arrow in FIG. 6D. This action misaligns the piston slot or groove 7 with the corresponding finger lobes 22 in the corresponding latch fingers 20 and forces the finger lobes 22 radially from the piston slot or groove 7 and pivotally from the finger base 23, such that the latch fingers 20 now engage and are seated in the fish groove 31 of the fish 30. The spear fishing tool 1 is now securely, yet removably, engaged with the fish 30 and the fish 30 may be removed by upward pressure exerted on the spear fishing tool 1 according to conventional techniques.

Figure 6B:
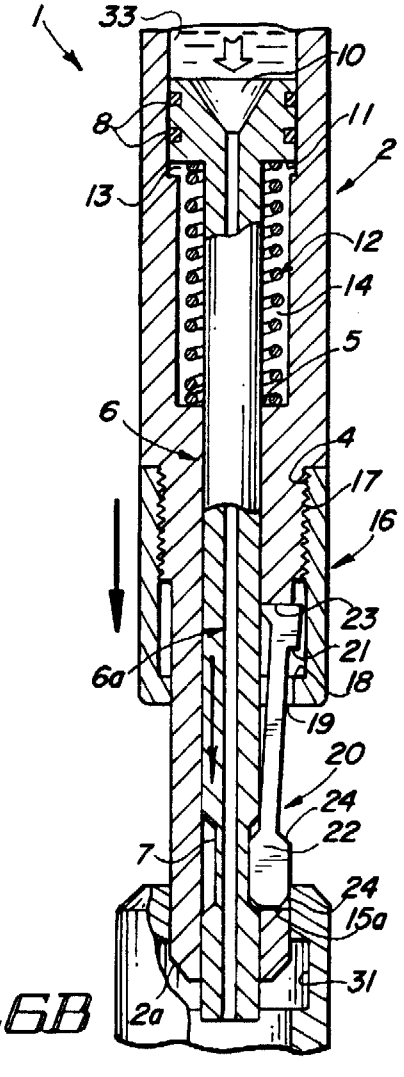
FIG. 6B is a sectional view of the spear fishing tool in operation, with the latch finger lobes retracted and ready for entry into the "fish"

Under circumstances where it is desired to disengage the spear fishing tool 1 from the fish 30 after either relocating the fish 30 or for other purposes, hydraulic or working fluid 33 pressure is again applied to the tubing 36 and the sub bore 29 and is exerted against the piston bevel 10 of the piston 6 to again force the piston 6 downwardly against the tension in the piston spring 12 and align the piston slot or grooves 7 with the respective finger lobes 22 of the corresponding latch fingers 20. The spear fishing tool 1 is then lifted and as pressure is exerted against the top finger bevel 24 by the fish 30, each of the finger lobes 22 are depressed into the aligned piston slot or groove 7 and the spear fishing tool 1 is quickly and easily disengaged from the fish 30, through the fish opening 32, as illustrated in FIGS. 6B and 6C. Hydraulic or working fluid 33 pressure is then released from the sub bore 29 and the piston 6 to effect return of the piston 6 to the position illustrated in FIG. 6A by operation of the piston spring 12 and extension of the respective finger lobes 22 of the latch fingers 20 from the misaligned piston slots or groove 7.

It will be appreciated by those skilled in the art that the spear fishing tool of this invention is characterized by simplicity, convenience and positive action in both engaging and disengaging of "fish" of substantially any description having a compatible engaging and latching configuration. The spear fishing tool 1 incorporates a single internal piston spring and requires no external springs for operation of the respective latch fingers 20 and the tool may be quickly and easily repaired and the latch fingers 20 removed and replaced or repaired by unthreading the finger collar 16 from the housing 2. Furthermore, referring to FIG. 3 of the drawings, a selected number of latch fingers 20, (four of which are illustrated) can be pivoted in the spear fishing tool 1, depending upon the lifting force required to remove the fish and the desired diameter of the housing 2. Moreover, the spear fishing tool of this invention can be constructed in substantially any size for operation in cased and uncased well bores of varying diameter and with engagement of "fish" of varied description, in substantially any working environment. Moreover, the spear fishing tool 1 is compatible with fluid pumps, including conventional mud pumps, hydraulic pumps and other hydraulic fluid and working fluid pressure apparatus for downhole operation, since working fluid pressure is applied to the conventional tubing 36 in a conventional manner.

Referring again to FIGS. 1 and 2 of the drawings, it will be further appreciated by those skilled in the art that the piston slot 7 can be either a continuous groove, as illustrated in FIG. 5, or multiple slots, depending upon the desired design of the working end of the housing 2. For example, discrete piston slots 7 can be provided in each circumstance where the latch fingers 20 are mounted radially around the diameter of the housing 2 and in the areas where the respective finger lobes 22 align with the piston 6. Alternatively, a single circular piston slot or groove 7 may be provided, as desired. In each case, the finger lobes 22 of the respective latch fingers 20 are able to recess in the piston slot(s) or groove 7 during operation of the spear fishing tool 1, as heretofore described.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. An apparatus for retrieving an object from a well bore, comprising a housing; a fluid-actuated piston disposed for reciprocation in said housing; bias means provided in said housing for normally biasing said piston into a first selected position in said housing; a piston bore longitudinally provided in said piston for flushing the object with the fluid; a plurality of finger slots radially disposed in said piston; and a plurality of fingers having one end thereof disposed in said housing, with the opposite ends of said fingers slidably seated in said housing, whereby said opposite ends of said fingers are sequentially recessed in said finger slots in said piston for entering the object and extended from said finger slots in said piston for engaging the object, responsive to reciprocation of said piston in said housing.

2. The apparatus of claim 1 comprising bevelled seat means provided in said housing for receiving said opposite end of said fingers.

3. An apparatus for retrieving an object from a well bore comprising a housing having at least one seat bevel; a fluid-actuated piston disposed for reciprocation in said housing; a spring provided in said housing for normally biasing said piston upwardly in said housing; a piston bore longitudinally provided in said piston for flushing the object with the fluid; at least one finger having one end disposed in said housing, with the opposite end of said finger extending from said housing and slidably engaging said seat bevel; at least one slot provided in said piston for selectively accommodating said opposite end of said finger responsive to downward reciprocation of said piston; and a collar engaging said housing and an opening provided in said collar for receiving said finger and retaining said one end of said finger in said housing, whereby said opposite end of said finger is slidably displaced on said seat bevel into said slot and into the object responsive to said downward reciprocation of said piston in said housing against the bias of said spring by hydraulic operation of the fluid and said opposite end of said finger is displaced on said seat bevel from said slot to engage the object responsive to upward reciprocation of said piston in said housing by operation of said spring.

4. The apparatus of claim 3 wherein said at least one slot comprises three slots radially disposed in said piston and said at least one finger comprises three fingers.

5. The apparatus of claim 3 wherein said at least one slot comprises four slots radially disposed in said piston and said at least one finger comprises four fingers.

* * * * *